US009004185B2

(12) United States Patent
Madero et al.

(10) Patent No.: US 9,004,185 B2
(45) Date of Patent: Apr. 14, 2015

(54) DOWNHOLE PLUG DROP TOOL

(75) Inventors: Paul Madero, Cypress, TX (US); Clint E. Mickey, Spring, TX (US); David A. Dolyniuk, Dickinson, TX (US)

(73) Assignee: Baker Hughes Incorporated, Houston, TX (US)

( * ) Notice: Subject to any disclaimer, the term of this patent is extended or adjusted under 35 U.S.C. 154(b) by 675 days.

(21) Appl. No.: 13/343,874

(22) Filed: Jan. 5, 2012

(65) Prior Publication Data

US 2013/0175053 A1 Jul. 11, 2013

(51) Int. Cl.
*E21B 23/06* (2006.01)
*E21B 33/12* (2006.01)

(52) U.S. Cl.
CPC ..... *E21B 33/12* (2013.01); *E21B 23/06* (2013.01)

(58) Field of Classification Search
CPC ... E21B 33/12; E21B 33/068; E21B 33/1204; E21B 34/14; E21B 34/00; E21B 34/06; E21B 23/06
USPC ..... 166/386, 193, 318, 387, 373, 332.1, 166/75.15, 181, 194
See application file for complete search history.

(56) References Cited

U.S. PATENT DOCUMENTS

| | | | | |
|---|---|---|---|---|
| 4,637,468 | A | 1/1987 | Derrick | |
| 5,335,727 | A * | 8/1994 | Cornette et al. | 166/278 |
| 7,100,700 | B2 | 9/2006 | Davis et al. | |
| 7,624,810 | B2 * | 12/2009 | Fould et al. | 166/387 |
| 2012/0048562 | A1 * | 3/2012 | Zimmerman et al. | 166/317 |

OTHER PUBLICATIONS

Bake Hughes, [online]; [retrieved Mar. 8, 2012]; retrieved from the Internet http://blogs.bakerhughes.com/reservoir/2010/09/18/completion-techniques-in-shale-reservoirs/, "Completion techniques in shale reservoirs" Baker Hughes Reservoir Blog, Sep. 18, 2010, 4p.

Written Opinion of the International Searching Authority; Date of Mailing Mar. 19, 2013, International Application No. PCT/US2012/067732: pp. 6.

* cited by examiner

*Primary Examiner* — Jennifer H Gay
*Assistant Examiner* — George Gray
(74) *Attorney, Agent, or Firm* — Cantor Colburn LLP

(57) ABSTRACT

A plug drop tool, including a body defining a chamber, a plug initially housed in the chamber and a member disposed with the body. The member is actuatable for selectively enabling communication between the chamber and an annulus at least partially defined by the body. The plug is movable into the annulus when the communication is enabled.

18 Claims, 2 Drawing Sheets

DOWNHOLE PLUG DROP TOOL

BACKGROUND

So called "plug and perf" operations are well known in the downhole drilling and completions industry, particularly with respect to unconventional resource plays (unconventional gas, shale gas, tight gas and oil, coal bed methane, etc.). In a plug and perf operation, a bottom hole assembly is run, e.g., on wireline, into a borehole that is typically cased and cemented and could include both horizontal and vertical sections. The bottom hole assembly includes an isolation tool, a setting tool, and one or more perforation guns. The setting tool is actuated for packing off a production zone with the isolation tool. The one or more perforation guns are then positioned in the borehole and triggered by a signal sent down the wireline. Typically, ball type plugs are used for the isolation tools, e.g., as they provide fluid communication with lower zones, which enables sufficient fluid flow for redeploying the perforation guns in the event that they do not fire properly. After perforation, the bottom hole assembly (sans isolation tool) is pulled out and a ball or other plug member dropped from surface for engaging a seat of the isolation tool for impeding fluid flow therethrough. While the process works adequately, it requires a significant amount of time and fluid to pump a ball downhole. Bridge plugs are occasionally used instead of ball type frac plugs, but these bridge plugs do not enable the aforementioned redeployment of failed perforation guns. Accordingly, alternatives for reducing the time and resources required in plug and play operations while maintaining the benefits of ball type frac plugs are well received by the industry.

SUMMARY

A plug drop tool including a body defining a chamber, a plug initially housed in the chamber, and a member disposed with the body and actuatable for selectively enabling communication between the chamber and an annulus at least partially defined by the body, the plug movable into the annulus when the communication is enabled.

A bottom hole assembly including an isolation tool, a setting tool operatively arranged for setting the isolation tool in a downhole structure, the setting tool initially connected to the isolation tool and disconnectable therefrom after setting, and a plug drop tool coupled with the setting tool, the plug drop tool configured to drop a plug, the plug operatively arranged to travel downhole and engage the isolation tool after disconnection from the setting tool for enabling isolation by the isolation tool.

A method of performing a downhole operation including running a bottom hole assembly into a downhole structure, the bottom hole assembly including a setting tool, an isolation tool, and a plug drop tool, setting the isolation tool in the downhole structure with the setting tool, disconnecting the setting tool from the isolation tool, deploying a plug from the plug drop tool, and engaging the plug with the isolation tool for enabling isolation by the isolation tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
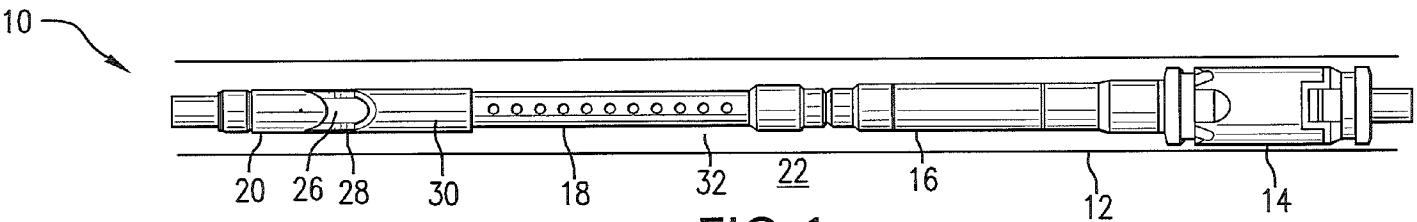
FIG. 1 schematically illustrates a downhole assembly.

Referring now to FIG. 1 an embodiment of the current invention is illustrated, namely an assembly 10 run into a downhole structure 12. The downhole structure, could be, e.g., a borehole that is lined, cased, cemented, etc. The assembly 10 is, e.g., run downhole by use of a wireline system. In the illustrated embodiment the assembly 10 includes an isolation tool 14, a setting tool 16, a perforation gun 18, and a plug drop tool 20.

Figure 4:
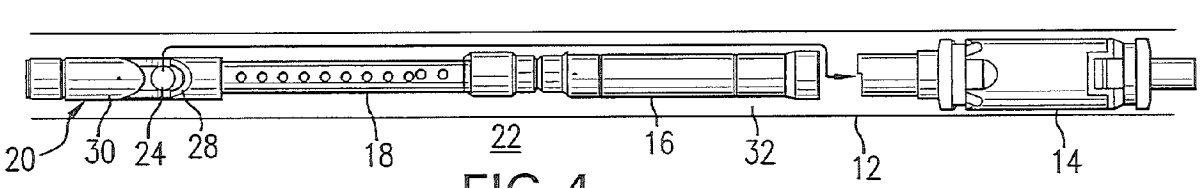
FIG. 4 is schematically illustrates the downhole assembly of FIG. 1 in an actuated configuration.

For example, in one embodiment, the assembly 10 is, e.g., a bottom hole assembly for a "plug and perf" operation. In this embodiment, the assembly 10 is positioned downhole and the isolation tool 14 is set in the structure 12 by the setting tool 16 for packing off a production zone 22. The isolation tool 14 and the setting tool 16 could be any suitable tools known in the art. For example, the isolation tool 14 could be retrievable, drillable, etc., and formed from composites, metals, polymers, etc. In one embodiment the setting tool 16 is an E-4 setting tool commercially available from Baker Hughes, Inc. The setting tool 16 is then uncoupled from the isolation tool 14 and the perforation gun 18 positioned within the structure 12 for perforating the zone 22, as generally illustrated in FIG. 4. Multiple perforation guns could be included in the assembly 10 for forming multiple perforated sections in each production zone.

After perforation, the uncoupled tools of the assembly 10 are removed (the isolation tool 14 remaining downhole) and a plug 24, corresponding to a complementarily formed seat in the isolation tool 14, is dropped downhole for isolating opposite sides of the plug tool 14, e.g., thereby enabling a pressure up event to fracture the production zone 22 through the perforations formed by the gun(s) 18. The plug 24 could be a ball or take any other suitable form or shape receivable by the isolation tool 14. The isolation tool 14 could include any suitable seat, such as the one taught in U.S. Pat. No. 7,600,572 to Slup et al., which patent is hereby incorporated by reference in its entirety.

Figure 5:
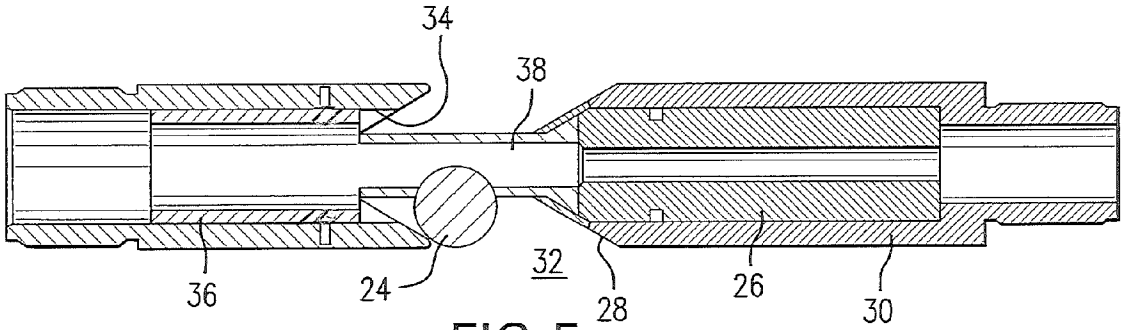
FIG. 5 is a cross-sectional view of the plug drop tool in communication with an annulus.
Figure 6:
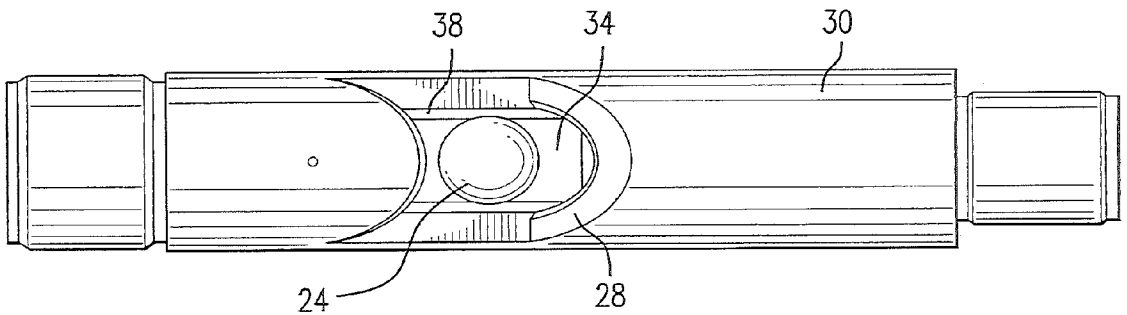
FIG. 6 is a side view of the plug drop tool of FIG. 5.

Advantageously, the assembly 10 includes the plug drop tool 20 so that the plug 24 can be dropped before or while the assembly 10 is pulled out so that the plug 24 only has to drop a small number of feet as opposed to plugs in conventional systems that must drop hundreds or thousands of feet from surface. In accordance with the above, the plug drop tool 20 is initially in the condition of FIGS. 2 and 3 during run-in and perforation and transitions to the condition of FIGS. 5 and 6 for deployment of the plug 24 after perforation.

Figure 2:
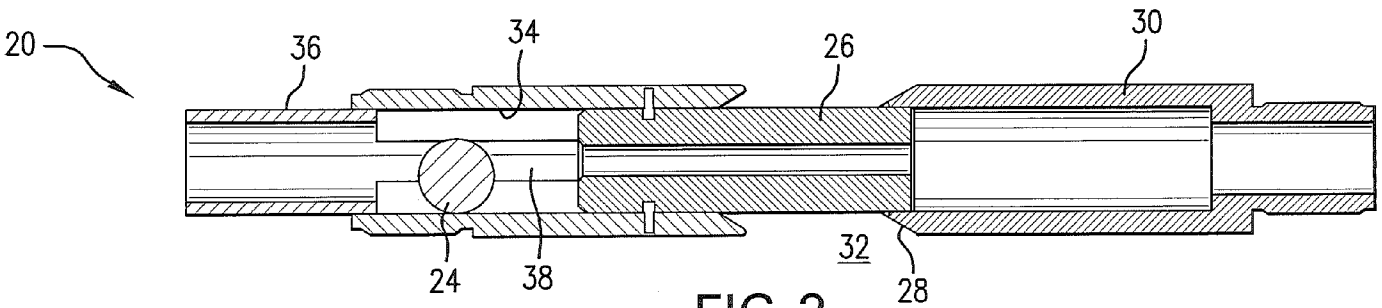
FIG. 2 is a cross-sectional view of a plug drop tool of the assembly of FIG. 1 in a closed configuration.
Figure 3:
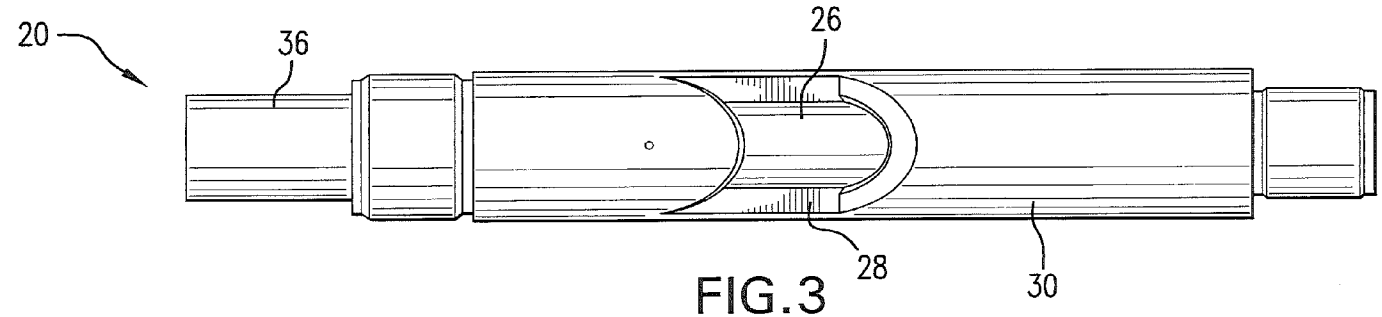
FIG. 3 is a side view of the plug drop tool of FIG. 2.

In the initial configuration of the tool 20 as illustrated in FIGS. 2 and 3, a valve member 26 is disposed with a window 28 formed in a body 30 of the plug drop tool 20. The window 28 is in communication with an annulus 32 formed between the assembly 10 and the structure 12, but, as shown in FIG. 2, blocked from communication with a chamber 34 formed in the body 30. Blockage of the window 28 accordingly blocks communication between the chamber 34 and the annulus 32. By blocking communication between the chamber 34 and the annulus 32, the plug 24 disposed within the chamber 34 can be run-in and moved with the tool 20. A cap 36 is included with the tool 20 for preventing the plug 24 from exiting the chamber 34 during run-in and positioning of the perforation guns 18. The cap 36 and valve member 26 may both be formed as sleeves or rods having passages therethrough for enabling the flow of fluid through the tool 20.

The cap 36 is secured to the valve member 26 via at least one strut 38 for enabling forces exerted on the cap 36 to be transferred to the valve member 26. For example the tool 20 could include a lead screw, spring or other resilient element, magnetic or hydraulically actuated components, etc., or any other device, mechanism, or system arranged for actuating the valve member 26. This actuation system could be triggered, e.g., by a signal sent via the wireline on which the assembly 10 is run. At least one release member 40, e.g., a set screw, can be included for preventing premature actuation of the valve member 26, e.g., until a predetermined threshold force is applied to the cap 36.

It is to be further appreciated that in addition or alternatively to axial movement, the member 26 could be actuated differently, e.g., rotational movement could align the struts 38 with the windows 28 for selectively enabling and disabling communication between the chamber 34 and the annulus 32. In another embodiment, the windows 28 are opened by forming the valve member 26 from a material that is dissolvable, degradable, consumable, corrodible, disintegrable, or otherwise removable in response to a downhole fluid, e.g., acid, brine, etc. Regardless of the mechanism used, actuation (movement, disintegration, etc.) of the valve member 26 will open the window 28, thereby enabling communication between the chamber 34 and the annulus 32.

When the chamber 34 is in communication with the annulus 32 the plug 24 is able to exit the chamber 34 by passing through the window 28 into the annulus 32. The plug 24 is operatively sized with respect to the annulus 32, i.e., having a dimension smaller than that of a radial clearance through the annulus 32. The radial clearance is generally defined by the radially largest portion of the tools past which the plug 24 must travel in order to engage with the isolation tool 14 (e.g., the drop tool 20, perforation guns 18, setting tool 16, etc.). By being so sized, the plug 24 is able to pass by the drop tool 20, the perforating gun 18 and setting tool 16 of the assembly 10 in order to engage in a corresponding seat of the isolation tool 14 and cause isolation as noted above.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A plug drop tool, comprising:
a body defining a chamber;
a plug initially housed in the chamber; and
a member disposed with the body and actuatable for selectively enabling communication between the chamber and an annulus at least partially defined by the body, the plug movable into the annulus when the communication is enabled.

2. The tool of claim 1 wherein the plug is a ball.

3. The tool of claim 1, wherein the body includes a window therein that is selectively blocked by the member.

4. The tool of claim 1, wherein the member is a rod slidably housed in the body.

5. The tool of claim 1, wherein the member is included with at least one cap, the cap arranged to prevent the plug from exiting the chamber.

6. The tool of claim 5, wherein the cap and the member are disposed on opposite axial sides of the plug and connected by at least one strut for enabling forces exerted on the cap to be transferred to the member for moving the member within the body.

7. The tool of claim 1, wherein axial movement of the member enables the communication between the chamber and the annulus.

8. The tool of claim 1, wherein the plug is operatively sized smaller than a radial clearance through the annulus.

9. A bottom hole assembly comprising the tool of claim 1.

10. The bottom hole assembly of claim 9, further comprising an isolation tool located downhole from the plug drop tool, the isolation tool operatively arranged for receiving the plug after passage of the plug through the annulus.

11. A bottom hole assembly comprising:
an isolation tool;
a setting tool operatively arranged for setting the isolation tool in a downhole structure, the setting tool initially connected to the isolation tool and disconnectable therefrom after setting; and
a plug drop tool coupled with the setting tool, the plug drop tool configured to drop a plug, the plug operatively arranged to travel downhole and engage the isolation tool after disconnection from the setting tool for enabling isolation by the isolation tool.

12. The assembly of claim 11, further including at least one perforation gun coupled with the setting tool and the plug drop tool.

13. The assembly of claim 11, wherein the plug drop tool is arranged to drop the plug through an annulus formed between the bottom hole assembly and the downhole structure.

14. The assembly of claim 13, wherein the plug is engagable with the isolation tool after disconnection of the isolation tool and the setting tool.

15. A method of performing a downhole operation comprising:
running a bottom hole assembly into a downhole structure, the bottom hole assembly including a setting tool, an isolation tool, and a plug drop tool;
setting the isolation tool in the downhole structure with the setting tool;
disconnecting the setting tool from the isolation tool;
deploying a plug from the plug drop tool after the setting of the isolation tool; and
engaging the plug with the isolation tool for enabling isolation by the isolation tool.

16. The method of claim 15, wherein deploying the plug drop tool includes opening at least one window in a body of the plug drop tool.

17. The method of claim 15, wherein deploying the plug drop tool includes actuating at least one member disposed with a body of the plug drop tool.

18. The method of claim 15, wherein engaging the plug with the isolation tool includes dropping the plug to the isolation tool through an annulus formed between the bottom hole assembly and the downhole structure.

* * * * *